US006433752B1

(12) United States Patent
Moncada et al.

(10) Patent No.: US 6,433,752 B1
(45) Date of Patent: Aug. 13, 2002

(54) MULTIPLE ANTENNA REFLECTORS FOR MICROWAVE IMAGING AND SOUNDING

(75) Inventors: John J. Moncada, Gardena; William D. Beightol, Riverside; Andrew Jacob Stambaugh, Marina del Rey, all of CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/834,433

(22) Filed: Apr. 13, 2001

(51) Int. Cl.[7] ..... H01Q 19/00
(52) U.S. Cl. ..... 343/756; 343/781 P; 343/840
(58) Field of Search ..... 343/756, 779, 343/781 R, 781 CA, 781 P, 912, 840

(56) References Cited

U.S. PATENT DOCUMENTS 4,525,719 A * 6/1985 Sato et al. ..... 343/761
5,557,292 A * 9/1996 Nygren et al. ..... 343/781 P
5,673,056 A * 9/1997 Ramanujam et al. ..... 343/756

* cited by examiner

*Primary Examiner*—Tan Ho
(74) *Attorney, Agent, or Firm*—Gates & Cooper LLP

(57) ABSTRACT

An apparatus and method for microwave imaging and sounding with large bandwidth radiometer reflector antennas in a compact form. The apparatus comprises a main reflector for reflecting a beam, a polarizer for polarizing the reflected beam into a first polarized beam and a second polarized beam, a first Frequency Selective Surface (FSS) reflecting a first selected frequency of the first polarized beam, a second FSS reflecting a second selected frequency of the second polarized beam, a first feed receiving the first selected frequency and a second feed receiving the second selected frequency. The method comprises reflecting a beam, polarizing the reflected beam into a first polarized beam and a second polarized beam, reflecting a first selected frequency of the first polarized beam, reflecting a second selected frequency of the second polarized beam, receiving the first selected frequency and receiving the second selected frequency.

24 Claims, 4 Drawing Sheets

MULTIPLE ANTENNA REFLECTORS FOR MICROWAVE IMAGING AND SOUNDING

STATEMENT OF RIGHTS OWNED

This invention was made with Government support under Contract Number F04701-97-C0033 awarded by the United States Air Force. The Government has certain rights in this invention.

BACKGROUND OF THE INVENTION

1. Field of the Invention

The present invention relates to systems and methods for microwave imaging and sounding, and in particular to a system and method for microwave imaging and sounding with large bandwidth radiometer reflector antennas.

2. Description of the Related Art

Conventional satellite microwave imaging and sounding systems typically use a single antenna with a multi-frequency horn to collect radiometric information over multiple frequency bands and a polarizer to separate the vertical and horizontal signal components.

Prior art radiometer reflector antenna designs for microwave imaging and sounding are fed by feed horns or fed by a beam waveguide system. Furthermore, the beam waveguide system in such antennas is designed with reflective surfaces and/or Frequency Selective Surfaces (FSSs) serially arranged in a single array. These systems typically operate from 10 to 90 GHz frequency range and occupy a large portion of the available spacecraft volume. Such prior art designs have been used on devices such as the advanced microwave sounding unit (AMSU) and the microwave humidity sounder (MHS).

Rather than using FSSs, other designs may utilize multi-frequency feeds in combination with diplexers to separate received signals into component frequencies. However, diplexers are bulky and result in inferior electrical performance.

To meet higher bandwidth requirements, there is a need to extend the operating frequency of transceivers to a range used on such satellites from 6 to 200 GHz. This results in a larger, more complicated, and costly design. Moreover, in many cases such performance improvements cannot be realized within the limited available physical envelope of the spacecraft employing prior art designs.

Furthermore, in the design of spacecraft, there are certain constant desirable objectives, which tend to vary only in emphasis for any particular application. These include reducing the time required to build components, improving the manufacturability, and of course, reducing component cost. A versatile design, easily modified through the alteration of simple parameters furthers these objectives.

There is a need in the art for systems and methods of microwave imaging and sounding which efficiently provide a broader frequency range in a compact form. There is a further need for systems and methods which are easily modified, less costly and lighter.

The present invention satisfies these needs.

SUMMARY OF THE INVENTION

To address the requirements described above, the present invention discloses an apparatus and method for microwave imaging and sounding with large bandwidth radiometer reflector antennas in a compact form.

The apparatus comprises a main reflector for reflecting a beam, a polarizer for polarizing the reflected beam into a first and second polarized beam, a first FSS reflecting a first selected frequency of the first polarized beam, a second FSS reflecting a second selected frequency of the second polarized beam, a first feed receiving the first selected frequency and a second feed receiving the second selected frequency.

The method comprises reflecting a beam, polarizing the reflected beam into a first and second polarized beam, reflecting a first selected frequency of the first polarized beam, reflecting a second selected frequency of the second polarized beam, receiving the first selected frequency and receiving the second selected frequency.

This invention is directly applicable to the design of radiometer reflector antennas, which utilize extremely large bandwidths and require packaging in a compact volume, as is often necessary in spacecraft applications. The invention allows the polarized components of an incoming beam to be directed to and used by the respective frequency specific feed horns in parallel, rather than in series.

One embodiment allows a substantial reduction in the packaging envelope, which is typically required to accommodate a sensor suite covering a broad frequency range. In addition to a more compact and efficient packaging arrangement, the present invention provides enhanced electrical performance by providing frequency-specific dedicated feeds, as opposed to multi-frequency feeds with bulky and lossy diplexers. This design allows simple control of frequency selection by replacing the FSS without impacting any other mechanical parameters of the design. Through a reflection and transmission filtering process the present invention provides versatile and convenient frequency selection and horn orientations.

In one embodiment, the efficient utilization of space is accomplished by rotating the surface geometry about one of the surface focal points, co-located at the main reflector focal point, and locating the respective feed horn at a second surface focal point.

Another embodiment provides a system and method for collecting the same data as prior art systems and methods utilizing one antenna reflector with a series of nested FSSs. However, the present invention produces a larger frequency bandwidth within a much tighter physical envelope by utilizing parallel groups of FSSs. The parallel groups of FSSs are enabled through the use of a flat plate polarizer which effectively creates two separated polarized component focal points of the main reflector. The parallel FSS groups are positioned relative to each of these main reflector focal points.

The foregoing allows collection of data as prior art systems and methods utilizing one antenna reflector but over a broader frequency range and in a more compact and versatile design.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1:
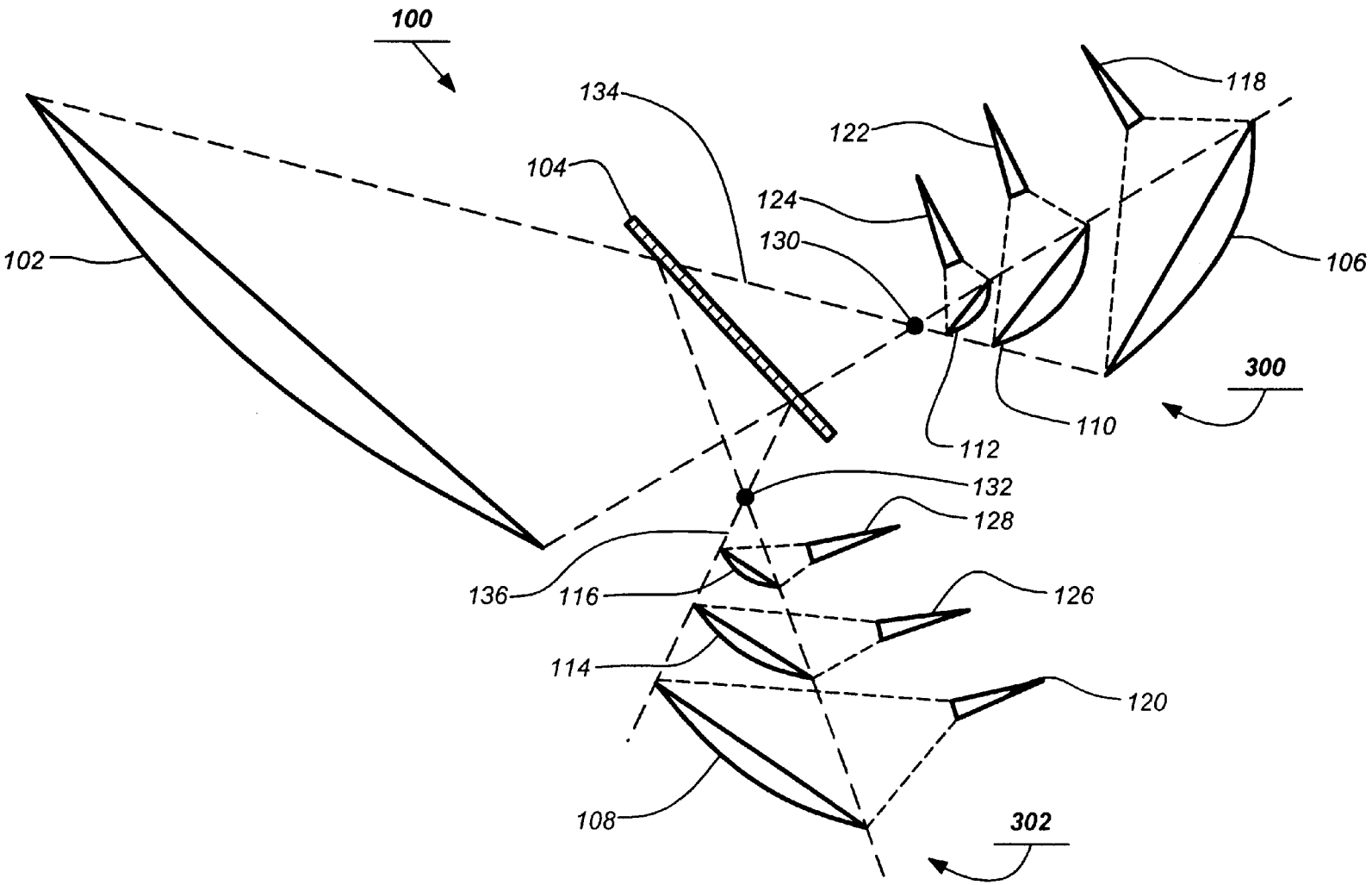
FIG. 1 illustrates an embodiment of the present invention with two sets of nested substantially ellipsoidal FSSs and a flat plate polarizer.

FIG. 1 illustrates an embodiment of the present invention with two sets of nested substantially ellipsoidal FSSs and a flat plate polarizer. The multiple reflector system for microwave imaging 100 consists of a main reflector 102, a polarizer 104 and multiple FSSs 106, 108, 110, 112, 114, 116 and antenna feeds 118, 120, 122, 124, 126, 128.

In a typical embodiment, the incoming beam or signal is received by the main reflector 102 and reflected to a polarizer 104 which polarizes the signal into two polarization components, directing the first polarized component to a first FSS 106 and the second polarized component to a second FSS 108. The first FSS 106 reflects a first selected frequency of the first polarized component to a first feed 118. The second FSS 108 reflects a second selected frequency of the second polarized component to a second feed 120.

The flat plate polarizer 104 polarizes the incoming signal and directs the two polarized components in different directions. The result is that each polarized component has a separate focal point (e.g. 130, 132) of the main reflector 102.

After the beam has been split into the two polarized components by the polarizer 104, the two resultant polarized component beams 134, 136 are separately directed to a nested first and second group 300, 302 of FSSs 106, 108, 110, 112, 114, 116. The first FSS group 300 includes the first, third and fourth FSS (106, 110, 112, respectively) and the second FSS group 302 includes the second, fifth and sixth FSS (108, 114, 116, respectively). The nested first and second FSS groups 300, 302, each receive one of the two polarized component beams 134, 136.

Each FSS 106, 108, 110, 112, 114, 116 reflects only selected radiation frequencies to the respective feed 118, 120, 122, 124, 126, 128 while allowing the remaining radiation spectrum to pass through to subsequent FSSs 110, 112, 114, 116. Thus, the nested FSS groups 300, 302, each process in parallel the different polarized components of the incoming beam across a range of frequencies. Any number of FSSs can be employed as necessary to capture other frequency ranges. Also, the design is easily modified through changes in the surface criteria with no alteration in the physical geometry.

Figure 2:
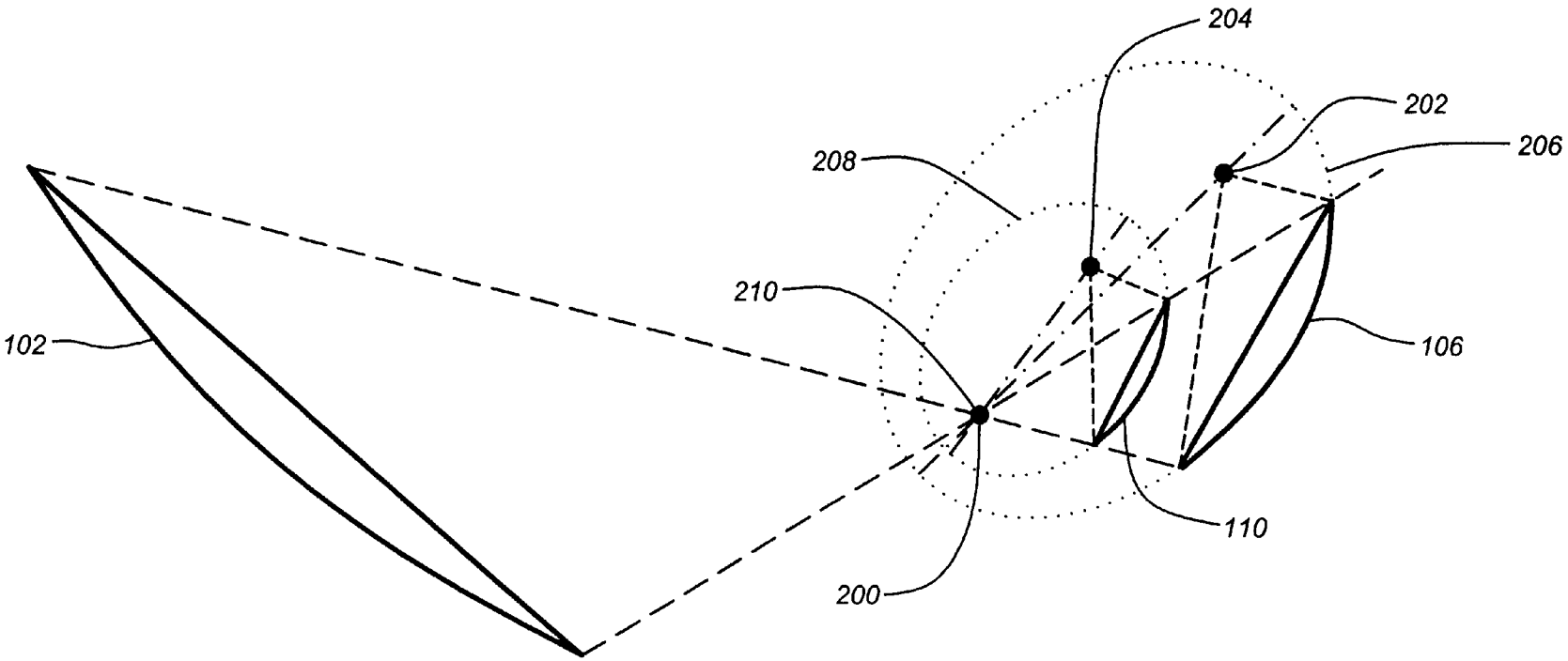
FIG. 2 illustrates the nesting geometry of the substantially ellipsoidal FSSs.

FIG. 2 illustrates the nesting geometry of the ellipsoidal FSSs 106–116 of FIG. 1. A main reflector focal point 200, which may be either the first or second polarized component beam 134, 136 focal points 130, 132, is a hub for a nested FSS group 300, 302. The surface of each nested FSS 106, 110 is constructed such that one surface focal point 210 is coincident with the main reflector focal point 200 and another surface focal point 202, 204 is positioned at its respective feed. In operation, the feeds are oriented to receive the selected frequencies reflected from their respective FSS. The FSSs may also be more tightly nested, such that the reflected selected frequency beams may intersect other FSSs and other reflected selected frequency beams, depending upon acceptable nearfield effects of the interacting constituents.

Figure 3A:
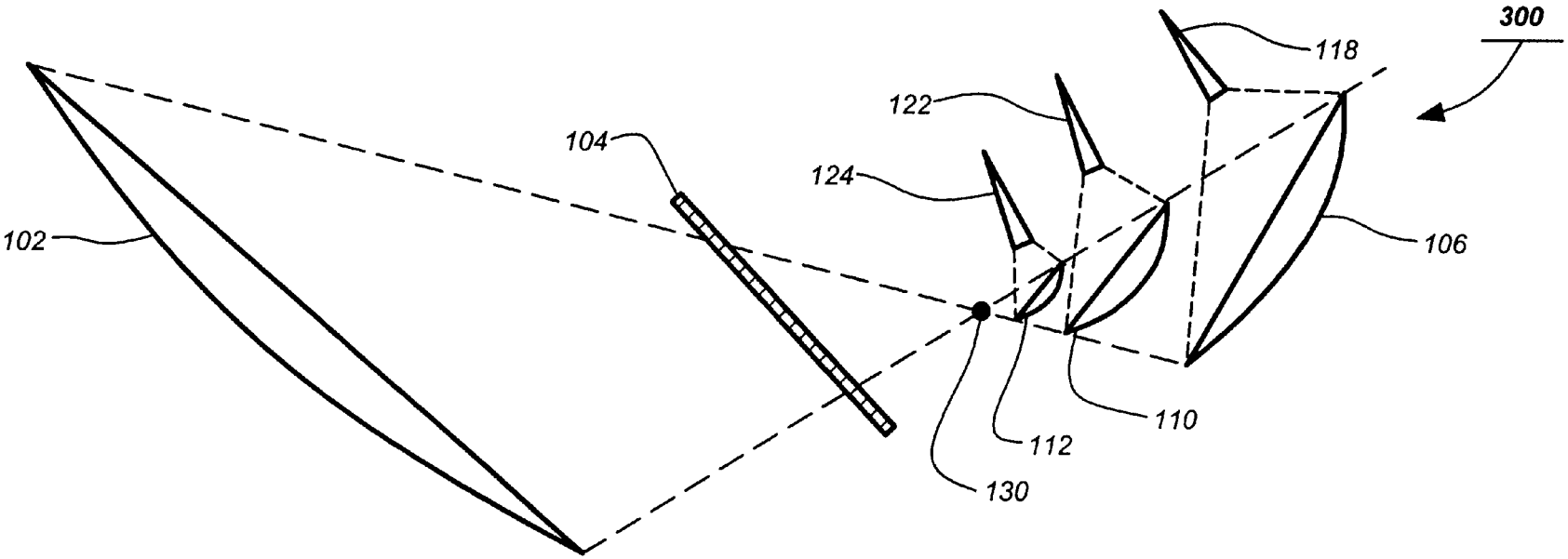
FIGS. 3A–3B illustrate the architecture of the FSS groups.
Figure 3B:
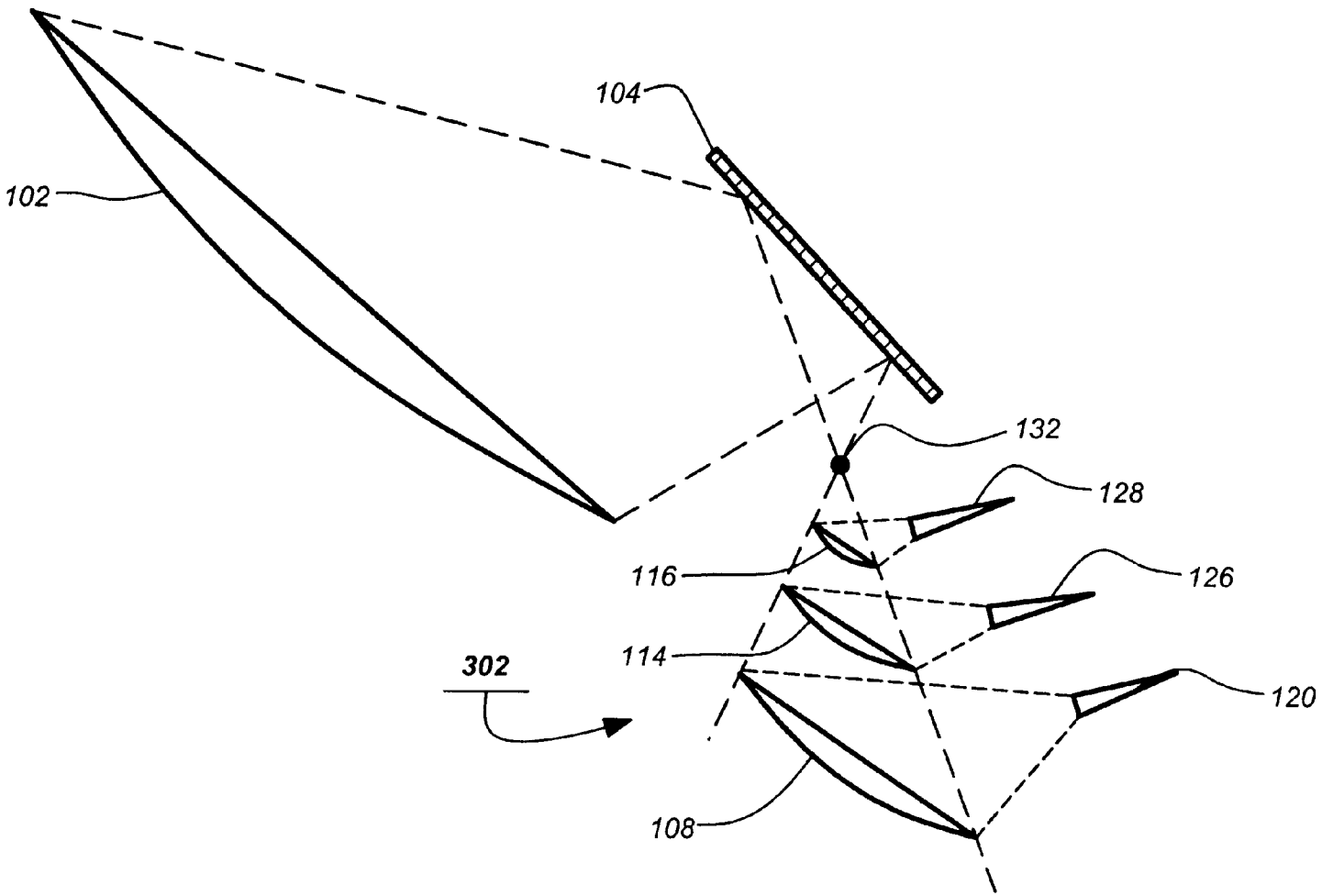

FIGS. 3A–3B illustrate the arrangement of the FSS groups. FIG. 3A depicts the first FSS group 300 positioned from the first polarized component focal point 130. FIG. 3B depicts the second FSS group 302 positioned from the second polarized component focal point 132. Packaging constraints are easily met through the choice of geometry, and orientation of the surfaces. This provides the ability to optimally space and point the signal feeds.

In another typical embodiment, the first, third and fourth feeds 118, 122, 124 receive one polarization component from the respective first, third and fourth FSSs 106, 110, 112 of a first FSS group 300 and the second, fifth and sixth feeds 120, 126, 128 receive the other polarization component from the respective second, fifth and sixth FSSs 108, 114, 116 of a second FSS group 302.

It should also be understood that the term "selected frequencies" used throughout this specification is meant to equivalently indicate bands of frequencies or even groups of bands of frequencies which can be reflected by a particular FSS.

CONCLUSION

This concludes the description of the preferred embodiments of the present invention. In summary, the present invention describes an apparatus and method for microwave imaging and sounding with large bandwidth radiometer reflector antennas in a compact form.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus, comprising:

a main reflector for reflecting a beam;

a polarizer for polarizing the reflected beam into a first polarized beam and a second polarized beam;

a first frequency selective surface (FSS) reflecting a first selected frequency of the first polarized beam;

a second FSS reflecting a second selected frequency of the second polarized beam;

a first feed receiving the first selected frequency; and a second feed receiving the second selected frequency.

2. The apparatus of claim 1, wherein the FSSs each have a surface having a first focal point and a second focal point.

3. The apparatus of claim 2, wherein the FSSs are substantially ellipsoidal.

4. The apparatus of claim 2, wherein the polarizer produces a first main focal point and a second main focal point of the main reflector.

5. The apparatus of claim 4, wherein each FSS of a first group of FSSs are formed by rotating the surface of each FSS about the first focal point, the first focal point being substantially co-located with the first main focal point, and locating the respective feed horn at the second focal point and each FSS of a second group of FSSs are formed by rotating the surface of each FSS about the first focal point, the first focal point being substantially co-located with the second main focal point, and locating the respective feed horn at the second focal point.

6. The apparatus of claim 1, further comprising:

a third FSS reflecting a third selected frequency of the first polarized beam; and a third feed receiving the third selected frequency.

7. The apparatus of claim 6, further comprising:

a fourth FSS reflecting a fourth selected frequency of the second polarized beam; and a fourth feed receiving the fourth selected frequency.

8. The apparatus of claim 7, further comprising:

a fifth FSS reflecting a fifth selected frequency of the first polarized beam; and a fifth feed receiving the fifth selected frequency.

9. The apparatus of claim 8, further comprising:

a sixth FSS reflecting a sixth selected frequency of the first polarized beam; and a sixth feed receiving the sixth selected frequency.

10. The apparatus of claim 9, wherein the first FSS, the third FSS and the fourth FSS are nested together in a first group and the second FSS, the fifth FSS and the sixth FSS are nested together in a second group.

11. The apparatus of claim 1, wherein the selected frequencies are in a frequency range from 6 to 200 GHz.

12. The apparatus of claim 1, wherein the polarizer is a flat plate polarizer.

13. A method of receiving signals, comprising:

reflecting a beam;

polarizing the reflected beam into a first polarized beam and second polarized beam;

reflecting a first selected frequency of the first polarized beam;

reflecting a second selected frequency of the second of the second polarized beam;

receiving the first selected frequency; and receiving the second selected frequency.

14. The method of claim 13, wherein each selected frequency is reflected by a surface, each surface having a first and second focal point.

15. The method of claim 14 wherein, each surface is substantially ellipsoidal.

16. The method of claim 14, wherein polarizing produces a first main focal point and a second main focal point.

17. The method of claim 16, further comprising reflecting a first and a second group of selected frequencies wherein each of the surfaces reflecting the first group of selected frequencies are formed by rotating the surface about the first focal point, the first focal point being substantially co-located with the first main focal point, and receiving the respective selected frequencies at the second focal point and wherein each of the surfaces reflecting the second group of selected frequencies are formed by rotating the surface about the first focal point, the first focal point being substantially co-located with the second main focal point, and receiving the respective selected frequencies at the second focal point.

18. The method of claim 13, further comprising:

reflecting a third selected frequency of the first polarized beam; and receiving the third selected frequency.

19. The method of claim 18, further comprising:

reflecting a fourth selected frequency of the second polarized beam; and receiving the fourth selected frequency.

20. The method of claim 19, further comprising: reflecting a fifth selected frequency of the first polarized beam; and receiving the fifth selected frequency.

21. The method of claim 20, further comprising:

reflecting a sixth selected frequency of the first polarized beam; and receiving the sixth selected frequency.

22. The method of claim 21, wherein the first selected frequency, the third selected frequency and the fourth selected frequency are reflected in a first group and the second selected frequency, the fifth selected frequency and the sixth selected frequency are reflected in a second group.

23. The method of claim 13, wherein the selected frequencies are in a frequency range from 6 to 200 GHz.

24. The method of claim 13, wherein polarizing is performed by a flat plate polarizer.

* * * * *

UNITED STATES PATENT AND TRADEMARK OFFICE

CERTIFICATE OF CORRECTION

PATENT NO. : 6,433,752 B1 
DATED : August 13, 2002
INVENTOR(S) : John J. Moncada, William D. Beightol and Andrew J. Stambaugh It is certified that error appears in the above-identified patent and that said Letters Patent is hereby corrected as shown below:

Column 1,
Lines 4-8, delete

"STATEMENT OF RIGHTS OWNED
This invention was made with Government support under Contract Number F04701-97-C0033 by the United States Air Force. The Government has certain rights in this invention."

Signed and Sealed this

Fourth Day of March, 2003

JAMES E. ROGAN
*Director of the United States Patent and Trademark Office*